US005707010A

United States Patent [19]

Manfre et al.

[11] Patent Number: 5,707,010

[45] Date of Patent: Jan. 13, 1998

[54] CONTROLLABLE SPRAY NOZZLE ASSEMBLY

[75] Inventors: Sam P. Manfre, Schaumburg; Ronald F. Olson, Melrose Park; Robert J. Adams, St. Charles; Jerry J. Hagers, Wheaton, all of Ill.

[73] Assignee: Spraying Systems Co., Wheaton, Ill.

[21] Appl. No.: 537,419

[22] Filed: Sep. 29, 1995

[51] Int. Cl.[6] ..... B05B 1/28

[52] U.S. Cl. ..... 239/296; 239/427; 239/434; 239/584

[58] Field of Search ..... 239/290, 296, 239/398, 418, 427, 433, 434, 583, 584; 251/360, 63.5; 137/315

[56] References Cited

U.S. PATENT DOCUMENTS

| | | | |
|---|---|---|---|
| 1,837,861 | 12/1931 | Green et al. | 239/290 |
| 2,214,035 | 9/1940 | Tracy | 239/290 |
| 2,365,752 | 12/1944 | Edwards | 239/584 |
| 3,053,461 | 9/1962 | Inglis | 239/584 |
| 3,232,540 | 2/1966 | Cassanmagnago | 239/418 |
| 3,351,288 | 11/1967 | Perr | 239/89 |
| 3,589,610 | 6/1971 | Wahlin et al. | 239/125 |
| 3,858,812 | 1/1975 | Williams et al. | 239/599 |
| 4,353,508 | 10/1982 | Butterfield et al. | 239/590.3 |
| 5,336,320 | 8/1994 | Hogan et al. | 239/584 |
| 5,598,974 | 2/1997 | Lewis et al. | 239/584 |

*Primary Examiner*—Joseph Kaufman
*Assistant Examiner*—Lisa Ann Douglas
*Attorney, Agent, or Firm*—Leydig, Voit & Mayer, Ltd.

[57] ABSTRACT

A controllable spray nozzle assembly with an elongated discharge passageway is provided with a short discharge orifice and valve seat insert element that is made separately for ease and accuracy of providing its orifice and valve seat and is mounted in sliding sealing relation with the outlet end of the passageway. A valve needle extends into the passageway and is selectively movable along the passageway for shut-off and/or flow rate control of the spray flow by the related axial positioning of its seat end relative to the separate discharge orifice and valve seat element that is inserted at the outlet end of the passageway. The separate discharge element has an external configuration that conforms to a portion of the nozzle body adjacent the outlet end for such seating thereon. The element's internal configuration defines a small discharge orifice through the element and a valve seat around the inner end of that orifice in opposed relation to the seat on the valve needle. The configuration and seating relation of the discharge element on the nozzle body assure that the orifice and the valve seat of the element are coaxially aligned with the adjacent end of the valve needle. The needle and its drive bushing preferably are made in one piece. Atomizing fluid is supplied through a plurality of bores through the nozzle body around the discharge passageway. These bores may be of reduced cross-section adjacent the outlet, which affords greater strength in this area of the assembly.

20 Claims, 4 Drawing Sheets

CONTROLLABLE SPRAY NOZZLE ASSEMBLY

FIELD OF THE INVENTION

The present invention relates generally to spray nozzle assemblies, and more particularly, to fluid assisted spray nozzle assemblies.

Air assisted spray nozzle assemblies are known that have a fluid nozzle head which is secured in a nozzle assembly and is formed with a flow passageway that defines a liquid discharge orifice and a valve seat. A selectively movable valve control needle is disposed within the flow passageway for controlling the liquid flow through the nozzle assembly. An air cap typically is disposed immediately downstream of the fluid nozzle head for defining an air chamber and defining an air nozzle to facilitate pressurized air atomization of the liquid as it is discharged from the nozzle assembly. It is common to operate the control needle in predetermined relatively high speed cyclic movement for achieving the timing and the form of the desired spray discharge. One example of such a previously known nozzle assembly is the "¼JAU" air atomizing nozzle heretofore marketed by Spraying Systems Co., Wheaton, Ill.

To achieve reliable flow control and shutoff seating of the needle with the valve seat, it is necessary that the discharge orifice, valve seat, and axial passageway, as well as the control needle, be manufactured with precise tolerances. In the prior nozzle assemblies, one relatively long and complex axial bore through the fluid nozzle head defines the liquid discharge orifice, the valve seat and the axial flow passageway in which the control needle is disposed. Relatively difficult and costly manufacturing procedures are required to form such an axial bore with the necessary concentricity for achieving shutoff by the needle without leakage and reliable control of the liquid discharge. Manufacturing of that nozzle head has resulted in quality control problems, undesirable part rejection rates and customer complaints due to leakage problems during use. With the prior such nozzle assemblies, part rejection or replacement due to seating or alignment problems required replacement of the entire nozzle head. Also, since the discharge orifice of the nozzle head defined the operating range of each nozzle assembly, in order to obtain a wide variety of flow capacities it has been necessary to manufacture complete nozzle heads with orifices of various sizes, which is costly.

OBJECTS AND SUMMARY OF THE INVENTION

It is an object of the present invention to provide a controlled spray nozzle assembly which is adapted for improved sealing engagement between the needle and the valve seat at the discharge orifice.

Another object is to provide a spray nozzle assembly as characterized above in which the discharge orifice and valve seat have improved concentricity, and hence, is adapted for more reliable performance.

A further object is to provide a spray nozzle assembly of the above kind which lends itself to easier and more economical manufacture, with less defective parts.

A related object is to provide a controlled spray nozzle assembly which provides flexibility and economy in providing nozzles of various capacities.

Another related object is to provide a spray nozzle assembly in which the liquid discharge orifice and liquid flow needle valve shutoff are located in close proximity to the discharge end of the nozzle assembly.

A related object is to provide a spray nozzle assembly of such type which permits easy quality control testing and reduced costs for defective parts.

Pursuant to the present invention, a controllable spray nozzle is provided with a nozzle body that has an elongated discharge passageway and a separate discharge orifice and valve seat element mounted in sealing relation with the outlet end of the passageway. A valve needle disposed in the passageway includes a seat on the end which is adjacent the outlet end of the passageway. The valve needle is selectively movable along the passageway for shut-off and/or flow rate control of the spray flow by the related axial positioning of the seat end of the needle relative to the separate discharge orifice and valve seat element that is mounted at the outlet end.

The discharge element has an external configuration that conforms to a portion of the nozzle body adjacent the outlet end for seating thereon in sealing relation with the passageway. The element's internal configuration defines a discharge orifice through the element and a valve seat around the inner end of that orifice in opposed relation to the seat on the valve needle. The configuration and seating relation of the discharge element on the nozzle body assure that the orifice and the valve seat of the element are coaxially aligned with the adjacent end of the valve needle. Movement of the needle portion axially of the passageway thereby will effect movement of the needle seat toward and away from the valve seat and the orifice in the discharge element to control the occurrence and/or rate of discharge of fluid from the nozzle through the orifice in accordance with such positioning of the valve needle.

In the presently preferred embodiment, the discharge element is an insert of generally cylindrical configuration and is mounted by sliding sealing engagement within the nozzle passageway which also contains the control needle. The insert abuts an interior flange of the nozzle body for retention purposes. The orifice portion of this insert projects outward from the nozzle body and into a larger opening through an end cap that is spaced outwardly from the nozzle body. An annular gap between the projecting portion of the insert and the perimeter of the large hole through the air cap define an annular nozzle for discharging atomizing fluid, normally air, outwardly around the orifice portion, from the manifold space which is provided between the nozzle body and the air cap. This assists in the atomization of the fluid discharged through the nozzle orifice.

The atomizing fluid is fed into the manifold space through a plurality of passages which extend through the nozzle body around the end portion that receives the insert. The use of the insert design of this invention affords preservation of material thickness and strength of the nozzle body in this end area.

An alternative form of the control needle includes an elongated nose portion which can be extended through the orifice for cleaning purposes. In addition the control needle preferably is of a one piece construction, including the drive bushing portion.

Figure 1:
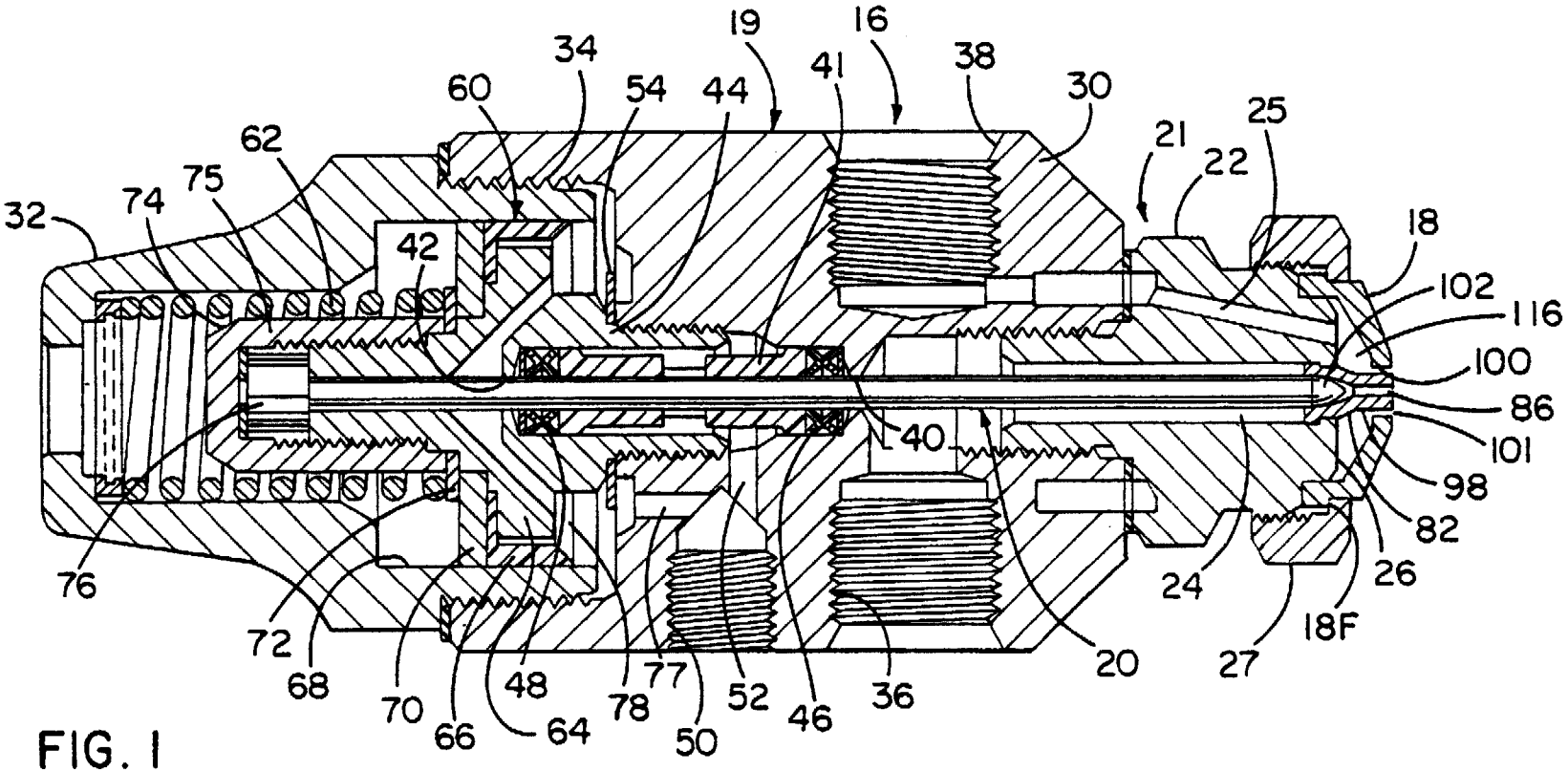
FIG. 1 is a diametrical sectional view taken along the longitudinal center axis of a spray nozzle assembly employing teachings of this invention.

While the invention is susceptible to various modifications and alternative constructions, a preferred embodiment and certain alternatives have been shown in the drawings and will be described. It will be understood, however, that there is no intention to limit the invention to these specific embodiments. On the contrary, the intention is to cover all modifications, alternative constructions and equivalents falling within the true spirit and scope of the invention.

DESCRIPTION OF THE PREFERRED EMBODIMENT

Figure 2:
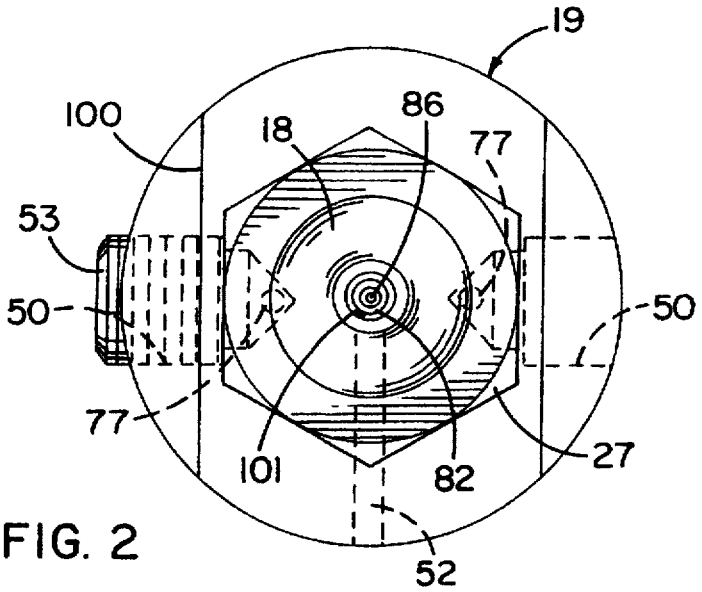
FIG. 2 is an end view of the assembly as in FIG. 1.
Figure 3:
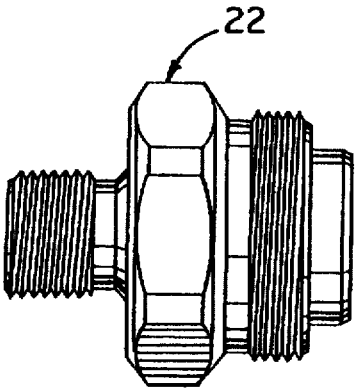
FIG. 3 is a side view of the nozzle body of the assembly of FIG. 1.

In the drawings, FIGS. 1 and 2 illustrate an air atomizing nozzle assembly 16 with a non-adjustable air nozzle cap 18. The basic structure and mode of operation of the nozzle assembly 16 are known in this art, for example in the aforementioned "¼JAU" air atomizing nozzle marketed by Spraying Systems Co. of Wheaton, Ill. Accordingly, the details of many of the assembly components and their operation in such an assembly are described only generally herein. The overall structure and mode of operation of the assembly 16 should be understood to be illustrative of only one example of a spray nozzle assembly in which the preferred embodiments of the invention may be implemented.

The spray nozzle assembly 16 comprises a main housing 19 which includes connections for supplying the liquid that is to be sprayed as well as an auxiliary atomizing fluid such as air, and mechanism for effecting controlled axial movement of a valve needle 20 in response to an external drive control input such as a solenoid-controlled operating pressure air line. A nozzle head 21 which includes a nozzle body 22 is affixed to the forward end of the housing 19. It includes a central axial passageway 24 for carrying the application fluid and one or more side bores 25 for carrying the auxiliary atomizing fluid to the discharge end 26. The discharge end carries the air nozzle cap 18, through which the application fluid is sprayed and/or atomized in a controlled manner. The cap has a close air-tight fit over the end 26 and is retained by a threaded nut 27 which engages over the cap flange 18F and onto a threaded end of the nozzle body 22.

The housing 19 includes generally cylindrical forward and rearward housing sections 30 and 32 which are joined to one another as by a threaded interconnection at 34. The forward housing section 30 includes a port 36 for connection of an appropriate conduit which supplies the application fluid, and a second connection port 38 to receive a conduit for supplying an auxiliary atomizing fluid, e.g. compressed air. The port 36 communicates with the passageway 24, and port 38 communicates with the bore(s) 25, through respective passages formed in the housing section 30.

The valve needle 20 is a long slender cylindrical element which extends generally co-axially through the housing 19 and the nozzle body 22. It extends through an opening 40 in the forward housing section 30, through a retainer 41 which is suitably supported in the housing section 30, and through an end opening 42 in a hollow packing nut 44 that is threadably mounted in the forward housing section 30, as illustrated. The retainer 41 includes end portions which abut and retain annular seals 48 around the shaft of the valve needle 20. The seals 48 and the sealing engagement of the packing nut with housing section 30 assure isolation of the application fluid from the actuation control fluid which is supplied through another lateral port 50. A bleed port 52 extends from the space between the seals 46,48 to the external periphery of the assembly 19 for venting any fluid which bypasses the seal 48 at either end of the retainer 41. By way of one example, the seals 46, 48 may be Quad-Ring® seals marketed by Minnesota Rubber Company of Minneapolis, Minn. A lock washer 54 is provided between the proximal end of the housing section 30 and an inner shoulder of the packing nut 44 for retention purposes.

The housing 19 includes control fluid ports 50 in opposite sides, as illustrated by the dashed lines in FIG. 2. (One such port 50 is illustrated 90° out of position in the cross-section view of FIG. 1 for convenient illustration purposes, and therefore appears juxtaposed over the bleed port 52 in FIG. 1.) One of these control fluid ports 50 is connected to a conduit which supplies the drive control fluid. The opposite port 50 may be used for connecting another control nozzle assembly 19 in series, or is closed by a pipe plug 53 as seen in FIG. 2.

The rear housing section 32 carries a drive piston assembly 60 and a compression spring 62 which is confined between an outer side of the piston 60 and an end wall or shoulder of the housing section 32 as illustrated. The piston assembly includes a piston 64 and a resilient annular cup-shaped sealing ring 66 which has sliding sealing engagement with the inner surface of a cylindrical bore 68 that extends co-axially in the housing section 32. The sealing cup 66 is held in position on the piston assembly by a pair of clamping rings or washers 70 and 72 that are held in position by a retainer cap 74 that is threaded onto the stem portion 75 of the piston 64. An enlarged bushing portion 76 of the valve needle 20 is joined to the piston 64 by being captured between the outer end of the piston stem 75 and the end wall of the retainer cap 74. Accordingly, the valve needle 20 is adjustably moved axially of the housing 19 in accordance with the selective axial movement of the piston assembly 60.

The compression spring 62 biases the piston assembly 60, and hence the valve needle 20, forward to a fully seated, i.e. valve "closed", position. The valve needle is controllably and adjustably moved axially in the opposite direction (to the left in FIG. 1) against the force of spring 62 by the control drive air which is supplied from an inlet port 50 through one or more connecting ports 77 into the cylinder chamber 78 on the forward side of the moveable piston assembly 60. As will be seen, this forward portion of the cylinder chamber which receives the driving control fluid is generally between the forward end surface of the cylinder assembly 60 and the rear surfaces of the housing section 30. The supply of control fluid, e.g. compressed air, is controlled externally, such as by solenoid actuated valves, for controlled adjustable opening of the valve and thereby allowing the application fluid to be discharged through the spray nozzle in a manner which is controlled as to timing of the flow. This may be a high speed cyclic on-off flow rate mode, e.g. as rapid as 180 on-off cycles per minute. Accordingly, accurate and highly reliable configurations and correlations between the seat end of the needle and the orifice and its related valve seat are required.

Referring now to the left end portion of FIG. 1 as well as to FIGS. 3–7, the discharge passage 24 through the nozzle body 28 is a cylindrical bore 79 of uniform cross-section and size from the inlet end to a radial shoulder 80 on the inner side of a shallow annular flange or lip 81 which extends radially inward at the outlet end of the passageway. A separate discharge insert element 82 is formed with an internal configuration to provide a valve seating surface 84 and a discharge orifice 86 and is mounted on the outer end of the nozzle body 22 in co-axial alignment with the valve needle 20. For this purpose, the discharge insert element 82 includes a main body 94 with a shoulder section 96 which is of a configuration and size for sliding into and along the bore 79 in sealing engagement with the wall of the passageway bore 79 and into abutment with the flange shoulder 80. This fixes the location of the valve seat surface 84 and the orifice 86 in co-axial alignment with the passageway 24 and thus with the valve needle end portion 102. This sliding sealing engagement of the insert element 82 in the bore 79 is in the nature of a force fit. Thus the insert 82 may be made removable and replaceable. A smaller nose portion 98 of the element 82 includes the discharge orifice 86 and extends outwardly from the nozzle body 28 into or through a central opening 100 in the air nozzle cap 18, as seen in FIG. 1. The nose portion 98 is of a slightly smaller diameter than the opening 100. Thereby an annular orifice space 101 is provided around the nose portion 98 for discharging an atomizing fluid jet parallel to and into the application fluid as the application fluid is discharged from the atomizing orifice 86.

The discharge insert element 82 is separately and accurately formed as a short, accurately sized and dimensioned element, as by machining, to effect such sliding sealing engagement in the bore 79 and to provide and accurately position the critical valve seating surface 84 and small discharge orifice passage 86 in co-axial alignment with the valve needle 20. The valve needle typically is co-axially positioned in the passageway bore 79. If errors are found in the manufacture or dimensioning of the insert element 82, it may be discarded and replaced without the need for discarding or replacing any other component of the nozzle valve assembly.

Figure 11:
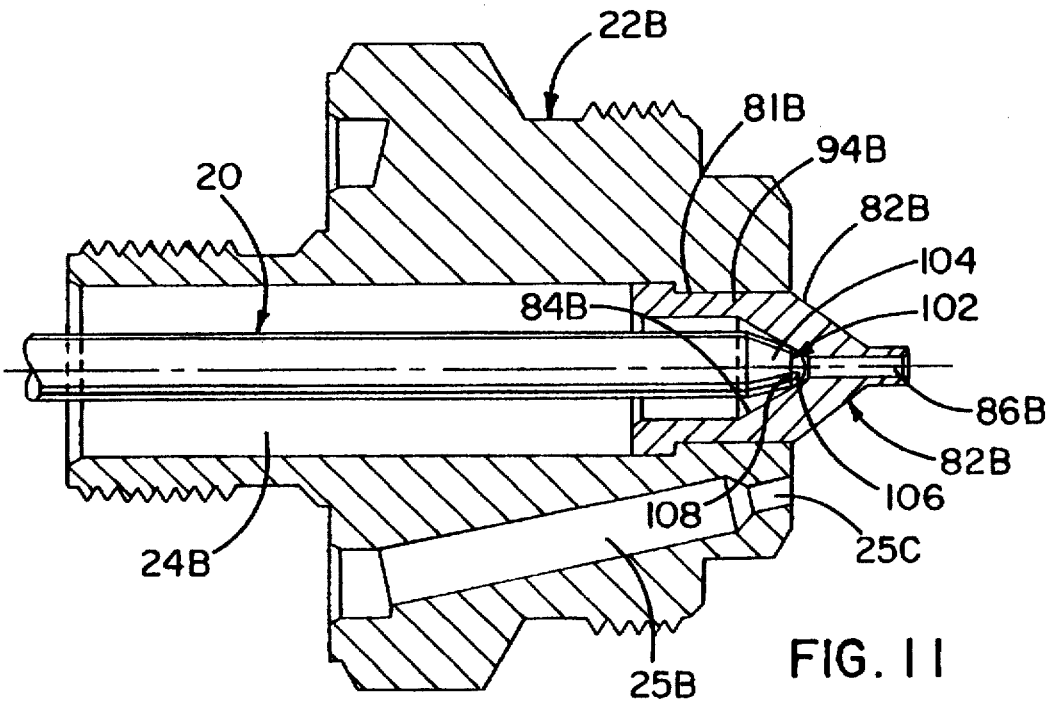
FIG. 11 is an enlarged sectional view similar to FIG. 4 and showing alternative embodiments of the nozzle body and the discharge element, and showing the outer end portion of a valve needle seated therein.
Figure 12:
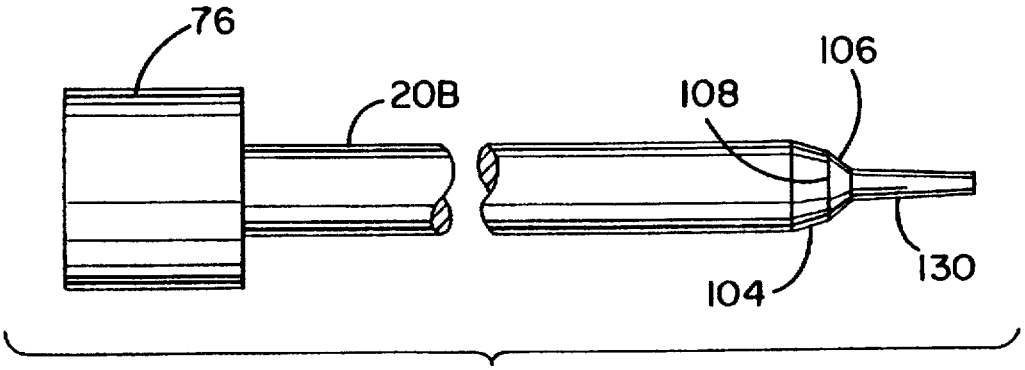
FIGS. 12 and 13 are enlarged side and end views, respectively of an alternative form of a valve needle employing teachings of this invention and useful in spray nozzle assemblies as in FIG. 1.

Referring particularly to FIGS. 11 and 12, the seating end portion 102 of the valve needle shaft 20 preferably and typically is formed with a first truncated conical surface 104 which intersects an inner conical surface 106 to define a relatively sharp or short-radius annular seating shoulder 108 therebetween. This shoulder seats against the conical inner annular seating surface 84, 84B of the insert element 82 when the valve 20 is in a seated position, thereby providing a circumferential line seal between the needle and the inner seating surface of the insert element 82; see FIG. 11. By way of one specific example, the surface 104 may be at a uniform angle of about 15° to the axis of the needle shaft 20 and the surface 106 may be at a uniform angle of about 45° to that axis. However, a variety of needle end configurations may be utilized, preferably retaining a similar circumferential line seal. Such variations include, for example, variations of the noted conical end surfaces and angles or a rounded seat surface seating against a conical surface as illustrated in FIG. 1.

Figure 4:
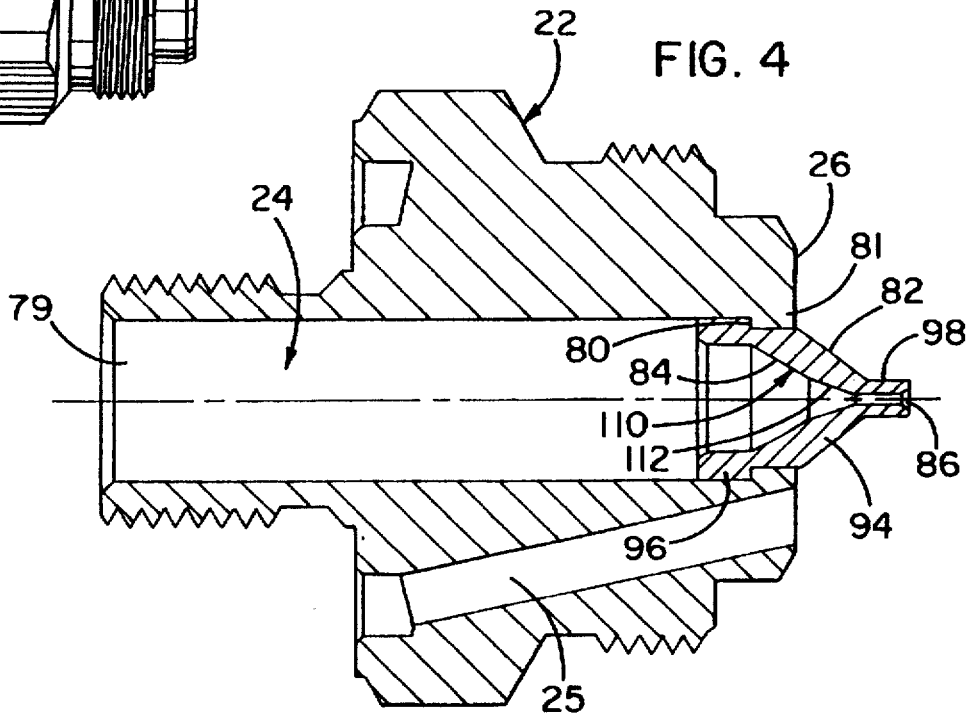
FIG. 4 is an enlarged sectional view of the nozzle body and discharge insert of the assembly as in FIG. 1.
Figure 5:
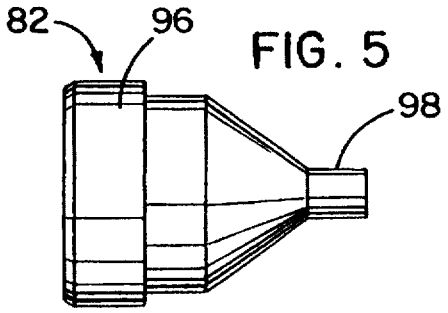
FIGS. 5, 6 and 7 are enlarged side, end and diametrical sectional views, respectively, of the discharge element of the assembly as in FIG. 1.
Figure 6:
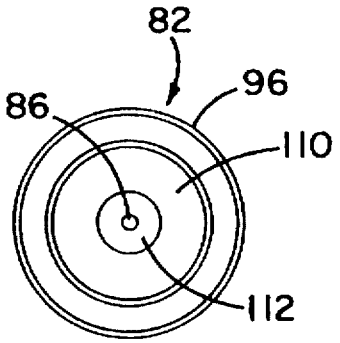
Figure 7:
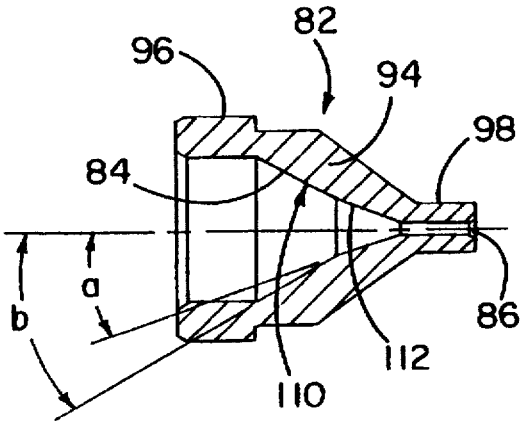

Referring particularly to FIGS. 4 and 7, the inner surface 110 of the insert element 82 comprises the truncated conical seating surface 84 which converges from the cylindrical inner surface of the flange portion 96 to an intersection with a second truncated conical surface 112 that extends to the inlet end of the orifice 86. By way of one example, the inward conical surface 112 may be at an angle "a" of about 20° to the central axis of the insert 82 and thus at the same angle to the axis of the bore 79, while the seating surface 84 may be at an angle "b" of about 30° to those aligned central axes.

The nozzle body 22 includes one or more bores 25 for flow of atomizing fluid therethrough and into a manifold space 116 between the outer end 26 of the nozzle body and the air nozzle cap 18. A plurality of such bores typically are provided through each nozzle body 22, e.g. three to six bores 25, in converging relationship to the axis of the discharge bore, as illustrated in FIGS. 1, 4 and 11. As illustrated in FIGS. 1 and 4, these bores may be of uniform size throughout their length. However, and referring particularly to FIG. 11, each of the bores 25B may be formed with a short outer end section 25C of reduced diameter, e.g. in the longitudinal area corresponding generally to the retainer flange 81, 81B. This allows preservation of a greater thickness of the material of the nozzle body 22B between these convergent end portions of the bores 25B and the main flow passageway 24B through the nozzle body. If necessary, a greater number of bores 25B, 25C may be provided in this design, e.g. six, to attain the requisite volume of flow of the atomizing fluid through the nozzle body.

Figure 8:
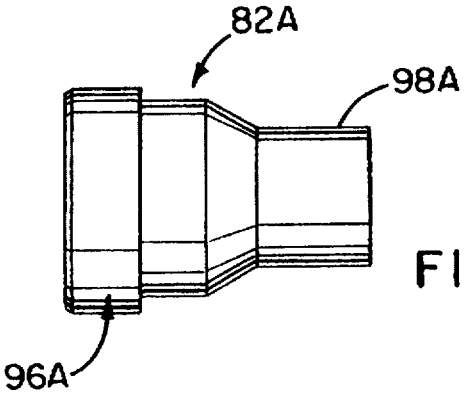
FIGS. 8, 9 and 10 are side, end and diametrical sectional views, respectively of an alternative discharge element employing teachings of this invention and which may be inserted in a spray nozzle assembly as in FIG. 1.
Figure 9:
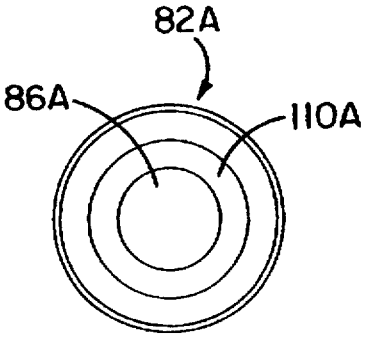
Figure 10:
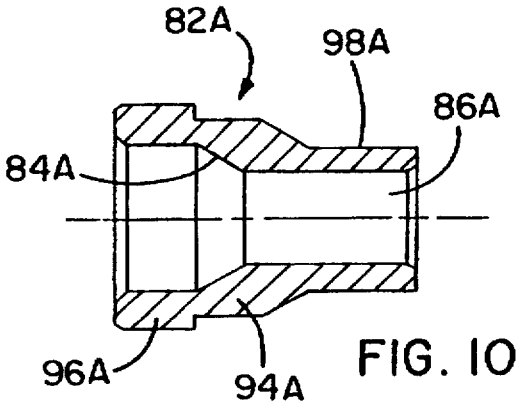

The discharge insert elements may be formed with valve seating surfaces and orifices of different sizes and configurations while retaining the same external configuration and size. This permits the provision of various sizes of orifices within valve assemblies having nozzle bodies 22 of the same size and configuration. That is, a choice of various nozzle orifice sizes and configurations can be provided simply by providing a variety of the discharge insert elements for use with standard nozzle bodies and related components. By way of example, FIGS. 8, 9 and 10 illustrate an alternative discharge element 82A. The element 82A has a main body 94A with a flange 96A for mounting in the same nozzle body 22 which will receive an insert element 82. Referring to FIG. 10, the insert 82A includes a single truncated conical inner surface 84A which provides the valve seat for the respective valve needle. The insert element 82A also forms a substantially larger orifice 86A than the orifice 86 of the insert 82. Inserts having other configurations for seating engagement in the same bore 79 and flange 81 may be provided with orifices of a variety of other sizes to attain different flow rates while using the same nozzle body and related components. Where the size variation of the orifice is substantial, such as between the inserts 82 and 82A, it may be necessary to also provide an air nozzle cap 18 with a different size opening 100 in accordance with the annular air discharge orifice 101 which is desired around the nose portion 98A. A valve needle of a larger diameter than the needle 20 typically is used with the insert 82A, though such a larger needle also may be used with the insert 82.

The discharge insert element 82 may be made from any suitable material, normally a metal, and may be made from different materials than the nozzle body 28. Suitable materials include, for example, aluminum, steel, 303 stainless steel, 316 stainless steel, Monel, Hastelloy and other special materials.

FIG. 11 also illustrates another alternative embodiment 82B of a discharge insert element. The body portion 94B is of somewhat greater length, as is the inner retention flange 92B, than in the inserts 82, 82A of FIGS. 4–10. Also, the insert 82B is formed with a single truncated conical inner surface 84B which constitutes the valve seating surface.

Figure 13:
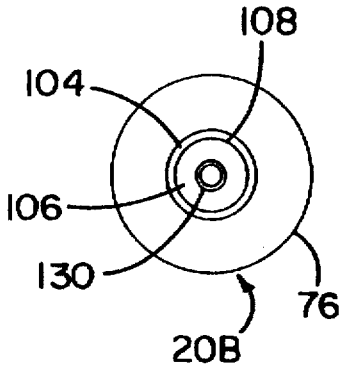

FIGS. 12 and 13 illustrate another embodiment of 20B of the valve needle. In this embodiment, an elongated nose portion 130 is provided on the distal end. The portion 130 is of a circular cross-section and of a diameter to extend through the respective orifice 86, 86A, 86B for clean-out purposes when the valve is seated. To this purpose, the nose portion 110 is of a slightly smaller diameter than the orifice of the discharge insert element with which it would be used, and preferably is tapered slightly to a reduced diameter at its distal end. The length of the nose portion 130 typically is such that it will extend through the discharge orifice when the valve needle is seated, i.e. "closed", and will be retracted from the respective orifice when the valve needle is in its fully retracted "open" position.

The illustrated nozzle head design may be used in a variety of similar needle-controlled spray nozzle assemblies. Thus, while the assembly 16 normally is used in intermittent on-off spraying situations, the same or a similar nozzle head design may be used in other valve assemblies that are controlled in other modes, for example with a liquid or mechanical drive for selectively positioning the needle. Also, the needle may be axially positioned for controlled variation of the rate of flow of the application fluid through the discharge orifice as well as in an on-off mode.

From the foregoing it can be appreciated that apparatus and related methods have been provided which accomplish the aforenoted objects of this invention.

It will be understood that other variations and modifications, and the substitution of equivalent devices and designs, can be effected within the spirit and scope of this invention, particularly in light of the foregoing teachings. It is contemplated by the following claims to cover any such modifications and other embodiments that incorporate those features which constitute the essential features of the invention within the true spirit and scope of the following claims.

What is claimed is:

1. A controllable atomizing nozzle assembly comprising a nozzle body which defines an elongated liquid discharge passageway that has an outlet end, a valve needle disposed in said passageway and including a seat on an end portion of said needle which is adjacent said outlet end of said passageway, said valve needle being movable along said passageway for selective positioning therealong, a discharge element substantially shorter in length than said body and passageway and substantially smaller in diameter than said body, said discharge element being seated in said passageway adjacent said outlet end in sealing relation with said passageway, said discharge element defining a discharge orifice therethrough and a valve seat which is circumjacent one end of said discharge orifice and is disposed in opposed relation to said seat on said valve needle for seating engagement by said valve needle seat said valve seat and said discharge orifice thereby being aligned with said end portion of said valve needle whereby movement of said needle portion axially of said passageway effects movement of said seat on said valve needle toward and away from said valve seat and said orifice and thereby controls the discharge of fluid from said nozzle through said orifice in accordance with such positioning of said valve needle, a fluid nozzle cap disposed over said outlet end of said passageway and having an opening therethrough, said nozzle cap and body defining an atomizing fluid chamber therebetween communicating with said opening, and said nozzle body defining a plurality of fluid supply passages disposed about said passageway which communicate with said atomizing fluid supply chamber for enhancing atomization of liquid directed through said elongated passageway and discharge element orifice.

2. The invention as in claim 1 wherein said orifice and said valve seat are coaxially aligned with said end portion of said needle and with said seat thereon when said discharge element is mounted in said nozzle body passageway.

3. The invention as in claim 1 including a plurality of said discharge elements having orifices of different sizes and each of said discharge elements having said external configuration whereby any one of said plurality of discharge elements may be replaceably seated in said body in sealing relation with said passageway.

4. The invention as in claim 1 wherein said discharge element is an insert which has sliding sealing engagement in said passageway.

5. The invention as in claim 4 wherein said nozzle body includes an internal shoulder adjacent said outlet end of said passageway and said discharge element is seated against said shoulder.

6. The invention as in claim 1 wherein a portion of said discharge element which defines an outlet end of said discharge orifice extending into said opening, and said portion of said discharge element and the perimeter of said opening defining an orifice for discharging atomizing fluid adjacent the outlet end of said orifice.

7. The invention as in claim 1 wherein said fluid supply passages comprise a plurality of bores formed in said body, each of said bores includes a primary bore portion of a first cross-sectional size and a terminal end portion adjacent said outlet end of said passageway, said terminal end portion being of smaller cross-sectional size than said primary bore portion.

8. The invention as in claim 1 wherein said needle is a single one-piece unitary element that includes a long slim primary needle body portion and a bushing portion, said primary body portion including said end portion with said seat thereon, and said bushing portion extending laterally from said primary portion for engaging a reciprocating drive portion of said assembly.

9. The invention as in claim 8 wherein said primary needle body portion and said bushing portion each is of a cylindrical configuration in cross-section, said bushing portion being of substantially greater diameter than said primary needle body portion.

10. A nozzle head for a controllable atomizing nozzle assembly which includes a valve needle that has a longitudinal axis and a seat on a distal end thereof and is reciprocable along said longitudinal axis, said nozzle head comprising a nozzle body which defines an elongated liquid discharge passageway that has an outlet end, a plurality of discharge elements each having a discharge orifice of different size, said discharge elements each being substantially shorter in length than said body and having an external configuration whereby anyone of said plurality of discharge elements may be replaceably seated in said body passageway adjacent the outlet end thereof in sealing relation with said passageway, each said discharge element defining a valve seat which is circumjacent one end of the discharge orifice thereof for sealing engagement by said seat on such a valve needle when said discharge element is seated in said body passageway, said valve seat and discharge orifice of a seated discharge element being coaxially aligned with said end portion of such a valve needle when said nozzle head is so mounted whereby movement of the valve needle axially of said passageway will effect movement of the seat on valve needle toward and away from said valve seat and orifice of a discharge element and thereby will control the discharge of fluid from said nozzle through said orifice in accordance with such positioning of said valve needle and the size of the discharge orifice of the discharge element, a fluid nozzle cap disposed over said outlet end of said passageway and having an opening therethrough, said nozzle cap and body defining an atomizing fluid chamber therebetween communicating with said opening, and said nozzle body defining a plurality of fluid supply passages disposed around said liquid passageway which communicate with said atomizing fluid supply chamber for enhancing atomization of liquid directed through said elongated passageway and the discharge orifice of the discharge element.

11. The invention as in claim 10 wherein each said discharge element is an insert adapted for sliding sealing engagement in said passageway.

12. The invention as in claim 10 wherein each said discharge element is an insert adapted for a press-fit in said passageway adjacent said outlet end.

13. The invention as in claim 10 wherein each discharge element has a portion which defines an outlet end of the discharge orifice thereof that extends into said opening when seated in said body passageway, and said portion of the discharge element and the perimeter of said opening defining an orifice for discharging atomizing fluid adjacent the outlet end of said orifice.

14. The invention as in claim 13 wherein:

each of said bores includes a primary bore portion of a first cross-sectional size and a terminal end portion adjacent said outlet end of said passageway, said terminal end portion being of smaller cross-sectional size than said primary bore portion.

15. A controllable atomizing nozzle assembly comprising an assembly body, a nozzle head secured to said body and defining a discharge outlet therefrom, said nozzle head including a nozzle body which defines an elongated liquid discharge passageway that has an outlet end, a valve needle disposed in said assembly body and extending into said passageway, said valve needle including a seat on an end portion of said needle which is adjacent said outlet end of said passageway, said valve needle being movable along said passageway for selective positioning therealong, a discharge element which has an external configuration that conforms to a portion of said nozzle body adjacent said outlet end, said discharge element being substantially shorter in length than said body and passageway, said discharge element being seated on said portion of said nozzle body in sealing relation with said passageway, said discharge element defining a discharge orifice therethrough and a valve seat which is circumjacent one end of said discharge orifice and is disposed in opposed relation to said seat on said valve needle, said valve seat and said discharge orifice thereby being aligned with said end portion of said valve needle whereby movement of said needle portion axially of said passageway effects movement of said seat on said valve needle toward and away from said valve seat and said orifice and thereby controls the discharge of fluid from said nozzle through said orifice in accordance with such positioning of said valve needle, a fluid nozzle cap disposed over said outlet end of said passageway and having an opening therethrough, said nozzle cap and body defining an atomizing fluid chamber therebetween and communicating with said opening, and said nozzle body defining a plurality of fluid supply passages disposed around said passageway which communicate with said atomizing fluid supply chamber for enhancing atomization of liquid directed through said elongated passageway and discharge element orifice.

16. The invention as in claim 15 and including means in said assembly body for selectively moving said needle axially along said passageway toward and away from said valve seat.

17. The invention as in claim 16 wherein said orifice and said valve seat are coaxially aligned with said end portion of said needle and with said seat thereon.

18. The invention as in claim 15 wherein said needle is supported in said assembly body, and including means in said assembly body for selectively moving said needle axially along said passageway.

19. The invention as in claim 18 wherein said needle is a single one-piece unitary element that includes a long slim primary needle body portion and a bushing portion, said primary body portion including said end portion with said seat thereon, and said bushing portion extending laterally from said primary portion for engaging a reciprocating drive portion of said assembly.

20. The invention as in claim 19 wherein said primary needle body portion and said bushing portion each is of a cylindrical configuration in cross-section, said bushing portion being of substantially greater diameter than said primary needle body portion.

* * * * *